US007757535B2

(12) United States Patent
Bytow

(10) Patent No.: US 7,757,535 B2
(45) **Date of Patent: *Jul. 20, 2010**

(54) PUNCHING MACHINE WITH SPRING-SUPPORTED WORK SUPPORT

(75) Inventor: Peter Bytow, Simmozheim (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/336,898

(22) Filed: Dec. 17, 2008

(65) Prior Publication Data

US 2009/0095046 A1 Apr. 16, 2009

Related U.S. Application Data

(63) Continuation of application No. 11/678,144, filed on Feb. 23, 2007, now Pat. No. 7,467,534, which is a continuation of application No. PCT/EP2005/009036, filed on Aug. 22, 2005.

(30) Foreign Application Priority Data

Aug. 26, 2004 (DE) ..... 20 2004 013 336 U

(51) Int. Cl.

| | |
|---|---|
| ***B21D 43/00*** | (2006.01) |
| ***B21J 7/12*** | (2006.01) |
| ***B21D 26/00*** | (2006.01) |
| ***B21D 37/00*** | (2006.01) |

(52) U.S. Cl. ..... 72/419; 72/434; 72/466.9; 72/482.91

(58) Field of Classification Search ..... 72/14.8, 72/351, 361, 419, 434, 453.13, 466.8, 466.9, 72/481.1, 482.91

See application file for complete search history.

(56) References Cited

U.S. PATENT DOCUMENTS

| | | | | |
|---|---|---|---|---|
| 2,772,735 | A | 12/1956 | Wakelee | |
| 4,779,443 | A | 10/1988 | Hoshi | |
| 5,361,615 | A | 11/1994 | Kirii et al. | |
| 5,715,721 | A | 2/1998 | Anders et al. | |
| 5,894,754 | A * | 4/1999 | Sartorio | 72/422 |
| 2001/0013240 | A1 | 8/2001 | Knodler et al. | |

FOREIGN PATENT DOCUMENTS

| | | |
|---|---|---|
| DE | 29702699 | 5/1997 |
| JP | 355077906 | 6/1980 |
| JP | 7256367 | 10/1995 |

* cited by examiner

*Primary Examiner*—Dana Ross
*Assistant Examiner*—Teresa M Bonk
(74) *Attorney, Agent, or Firm*—Fish & Richardson P.C.

(57) ABSTRACT

A punching machine is provided with a tool holder for a punching tool and a die having a cutting edge which can be passed by the punching tool in a machining stroke direction and a return stroke direction. The machine includes at least one work support, supported by at least one spring element. The work support is arranged in the region of the die, and the spring force of the spring element is adjustable.

20 Claims, 2 Drawing Sheets

PUNCHING MACHINE WITH SPRING-SUPPORTED WORK SUPPORT

RELATED APPLICATIONS

This application is a continuation of U.S. application Ser. No. 11/678,144, filed on Feb. 23, 2007, which is a continuation application and claims priority under 35 U.S.C. §120 to PCT/EP2005/009036, filed on Aug. 22, 2005, and designating the U.S., and claims priority under 35 U.S.C. §119 from German Application No. 20 2004 013 336.9, filed on Aug. 26, 2004. The contents of all of these priority applications are hereby incorporated by reference in their entirety.

TECHNICAL FIELD

The invention relates to a punching machine with a spring-supported work support, and a method of using such a punching machine.

BACKGROUND

When workpieces, e.g. workpieces of sheet steel, are punched, a burr is frequently formed on the cutting edge of the die, projecting from the cutting edge of the die in the return stroke direction of the blanking punch. The nature and extent of the burring depend on various factors such as the material machined, the cutting geometry, and/or the condition of the tools used. After the punching process the workpiece, after being at rest during the preceding machining process, is displaced transversely to the direction of movement of the blanking punch, either to transfer it to the next machining position or to remove it from the machine after machining.

If, after machining, the workpiece is not raised a certain distance from the die and supported in a raised position, the workpiece slides in a displacement movement on a die surface that is aligned with the cutting edge in the direction of displacement. During this movement, the burr projecting from the cutting edge of the die can cause scratches on the workpiece side facing the die, even if the burr projects only a few hundredths of a mm beyond the cutting edge.

To eliminate this drawback a method, among other things, is proposed in DE 297 02 699 U1 for movably supporting a work support on the base body of the die against the action of a restoring force in the machine stroke direction of the blanking punch. A work support supported by a spring on the base body of the die, for example, is proposed for this purpose. One problem that has arisen here is that in the case of heavy workpieces, the work support is forced downwards by the intrinsic weight of the workpiece and consequently the underside of the workpiece is again moved close to the cutting edge and even rests on the die surface. A burr on the cutting edge therefore again causes scratches on the underside of the workpiece. If stronger spring elements are used, the spring elements do not yield sufficiently during punching and the work support is pushed so strongly against the underside of the workpiece that lighter, and hence generally thinner workpieces are deformed during the punching process.

JP 07256367 A proposes that a brush table be used where the brushes are firmly arranged with one end on one plate and the other free end projecting through a second plate which runs parallel to the first plate and is vertically adjustable relative to the first plate. This measure can alter the stiffness of the brushes. In order to adapt the punching machine to workpieces of different weight the entire brush table must therefore be modified by adjusting the height of the plates relative to each other. Moreover, brushes suffer from the disadvantage that they wear. Finally, even in the arrangement presented in JP 07256367 A, the brushes may push through in the case of heavy workpieces and the workpiece may rest on the die, resulting in scratches.

SUMMARY

The present disclosure features punching machines on which workpieces of different weight can be machined without damage.

In the punching machines disclosed herein, a spring element supports a work support, and the spring force of the spring element can be adjusted. This measure enables the punching machine to be easily adjusted to workpieces of different weight. In particular, the spring force can be adjusted so that the workpiece is kept at a safe distance from the cutting edge during transport but where the spring force is not so great that the workpiece is deformed during the punching process. The spring force is therefore chosen so that when the blanking punch is in its initial position the workpiece is kept at a certain distance from the die, the spring elements yield when the blanking punch is lowered, and the workpiece is pushed by the blanking punch, e.g., by extension of the spring, against the die before the part to be punched is punched out during further movement of the punch in the fastening stroke direction.

In some implementations, the work support is arranged in the region of the die, i.e. close to the die, and thus the adjustment need not be carried out on the entire work table. It is sufficient to protect the workpiece locally against scratching in the region of the die. An arrangement in the region of the die is understood to include both an arrangement on the die itself, in which case the spring element is supported on the base body of the die, and an arrangement outside the die on the work table, in which case the spring element is supported on the work table or on the substructure of the work table.

The spring element can be adjusted, for example, by preloading a spring to varying degrees. In certain spring elements provision can be made for the spring constant to be variable. A wide variety of components may conceivably be used as spring elements, for example spiral or cup springs and rubber spring elements. To prevent the workpiece from being raised too far, a stop may be provided which limits the movement of the spring element or work support in the return stroke direction.

In a particularly preferred embodiment provision may be made for the spring element and the work support to be arranged on a work table in the vicinity of a die holder. In the state of the art according to DE 297 02 699 U1, spring elements are arranged in the die itself and are supported on a base body of the die. This means that suitable spring-mounted work supports must be provided on each die. This is relatively expensive. Moreover, spring elements arranged in such a manner are difficult to reach and control, so that adjustment of the spring force generally is not possible. It is therefore advantageous to arrange the spring elements with the work support on the work table so that so that they are independent of the die. A suitable device may be provided on the work table for controlling the spring elements and therefore for adjusting the spring force.

In some implementations, the spring element is advantageously designed as a pneumatic spring. The spring constant of such a spring element may be adjusted extremely easily and accurately by adjusting the air pressure. A pressure chamber may be provided in which is formed an air cushion supporting and spring-mounting the work support.

An advantageous design of the punching machine is provided when the work support comprises a support element mounting supported by the spring element and a support element mounted therein. As a result of this measure support elements, for example, are provided which have a low coefficient of friction. For example, the support element may be designed as a roll so that the workpiece can be moved with little resistance along the workpiece support.

It is particularly preferable for the support element mounting to be designed as a ball bearing and the support element as a ball. This measure enables the workpiece to be moved along the work table in all directions with little friction. Such a spring-supported work support is extremely low-wearing.

It is also conceivable for the work support supported by the spring element to comprise one or a plurality of brushes. For example, a brush as the support element may be secured directly to the spring element and/or may be supported by it. Alternatively, one or a plurality of brushes could be arranged in a support element mounting designed as a brush holder and therefore represent the support element. The brush holder could be supported by the spring element.

In some implementations, provision may be made for the spring force of the spring element to be adjusted manually. An operator of the punching machine is therefore able to adjust the spring force of the spring element by manually actuating adjusting or operating means, for example a pressure regulating valve, once he knows the weight of the workpiece, and can therefore adapt the punching machine to the workpiece to be machined.

The handling of the punching machine is generally simplified if the spring force is automatically adjusted. For example, the weight of a workpiece can be recorded, in particularly automatically recorded, at the beginning of a machining process, and on this basis the spring force can be automatically adjusted without the intervention of an operator. Alternatively the weight, or another characteristic, for example the workpiece thickness, of a workpiece to be machined, to which the workpiece weight is assigned, can be inputted so that a control system is able to adjust the spring force on the basis of this information.

In an advantageous further development provision may be made for the spring force to be adaptable during the machining of a workpiece. For example, the spring force may be adjusted manually as the weight of the workpiece is reduced. However, the spring force is preferably adapted automatically to the weight of the workpiece during machining. In some instances, the weight reduction of the workpiece that occurs with each punching process during a certain machining operation may be known, and the spring force may be adapted during machining on the basis of this knowledge. Alternatively, the weight of the workpiece may be recorded continuously or quasi-continuously during machining, i.e., after each punching process or after a predetermined number of punching processes, and the spring force may be adapted or adjusted on the basis of the recorded weight of the workpiece. This adjustment during machining further reduces the likelihood of scratching of the underside of the workpiece and bending of the workpiece during the punching process.

Automatic adjustment of spring force is possible, particularly if weight recording means are provided for recording the weight of a workpiece to be machined.

The spring force can also be adjustable so that the workpiece is raised after machining and before displacement. Before the punching process the spring force can therefore be reduced so that the workpiece lies on the die. After the punching process the spring force can be increased so that the workpiece is raised sufficiently from the die to prevent scratching during subsequent displacement of the workpiece. A lifting movement of the support elements can therefore be controlled by adjusting the spring force.

In a further development, provision can be made for the weight recording means to be connected to a control system for adjusting the spring force. Here the control system actuates adjusting means which depend on the nature of the spring element. In the case of a pneumatic spring element, a compressor or valve may be provided as adjusting means, for example, to generate a certain pressure in the pressure chamber. A sensor is also provided for recording the pressure in the pressure chamber which can then be fed back to the control system so that the pressure in the pressure chamber and hence the spring force of the spring element can be regulated. Such a regulation is also conceivable for any other type of spring element.

In some implementations, a single, in particular an integral work support surrounding the die or cutting edge may be provided with one or a plurality of adjustable spring elements. However, it is advantageous for a plurality of work supports each interacting with one or a plurality of adjustable spring elements to be arranged in the region of the die, and in particular for these to be arranged in the circumferential direction of the die holder. A work table on which the work supports can be arranged is frequently divided into different segments which are in part able to move relative to the die holder. In such punching machines it is easier to provide a plurality of work supports.

In some implementations, a work table may be provided on which the die is arranged, the work table being designed as a brush table outside the die and in the region in which one or a plurality of spring-supported work supports are arranged. Alternatively, provision may be made for the work table in this region to be designed as a ball bearing table so that larger workpieces can also be moved relative to the punching tool and the die. The workpiece is also supported outside the die region to prevent damage. However, the workpiece is raised or spring supported only in the region of the die in order to prevent scratching of the underside of the workpiece due to a burr on the cutting edge of the die.

In other aspects, the invention features methods of utilizing the punching machines described herein.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
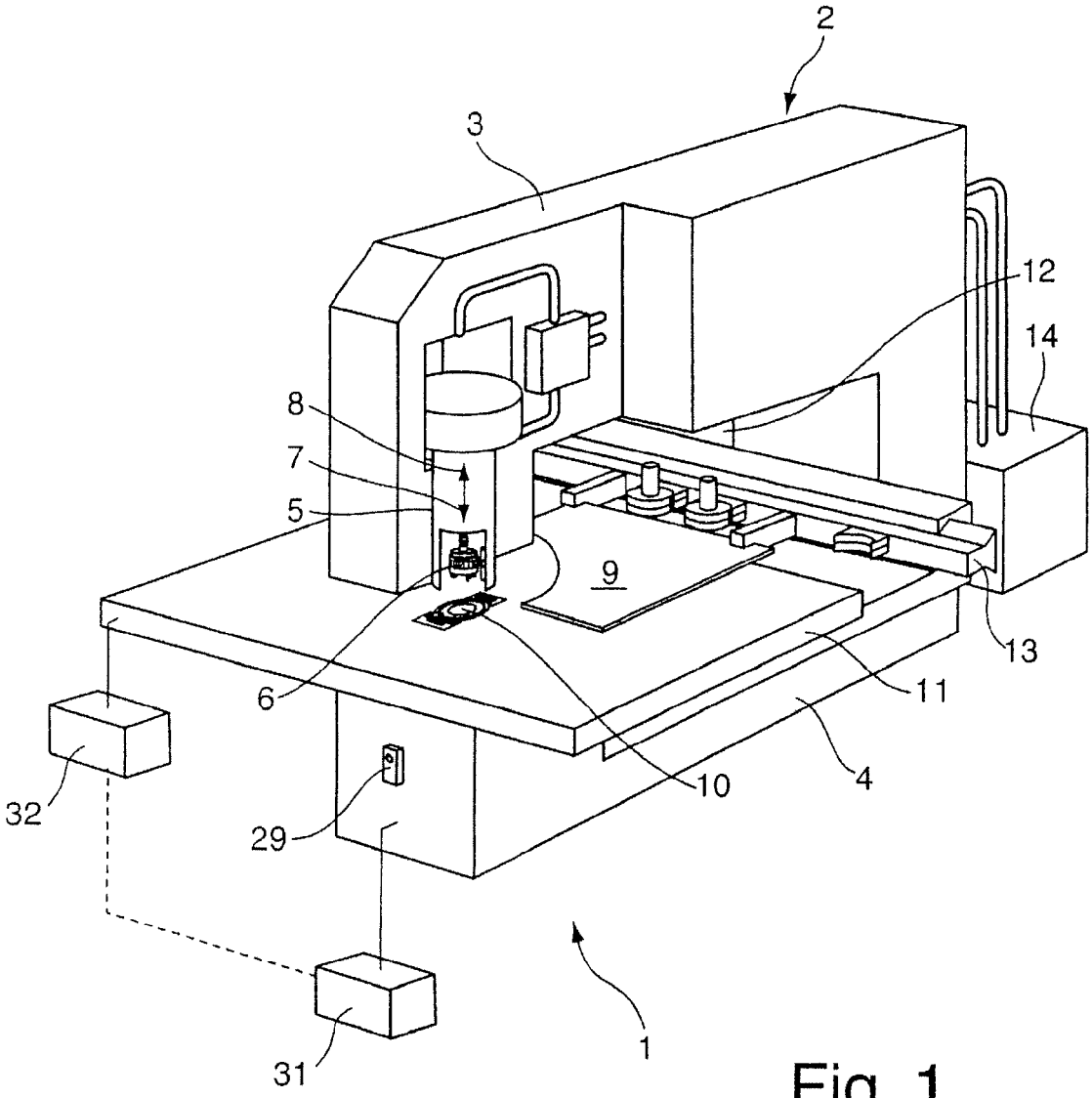
FIG. 1 is a perspective view of a punching machine with spring-supported work supports.

According to FIG. 1 a punching machine 1 has a C-shaped machine frame 2 with an upper frame leg 3 and a lower frame leg 4.

A drive 5 is fitted to the free end of upper frame leg 3 for a punching tool in the form of a blanking punch or for a tool mounting 6 provided with the blanking punch. By means of drive 5 tool mounting 6 can be moved rectilinearly together with the blanking punch in a machining stroke direction 7 or return stroke direction 8. Movements in the machining stroke direction 7 or return stroke direction 8 are performed by tool mounting 6 and the blanking punch during the working strokes for machining workpieces and for return strokes following the working strokes.

During workpiece machining, and in the example shown during the punching machining of steel sheets 9, the blanking punch interacts with a lower punching tool in the form of a punching die 10. This is integrated in a work table 11 which is in turn mounted on lower frame leg 4 of punching machine 1. The relative movements of metal sheet 9 concerned, required during the workpiece machining, relative to the blanking punch and punching die 10, are performed by means of a coordinate guide 13 of normal design accommodated in a gap space 12 of machine frame 2. A control system 14 is provided for controlling the punching machine.

Figure 2:
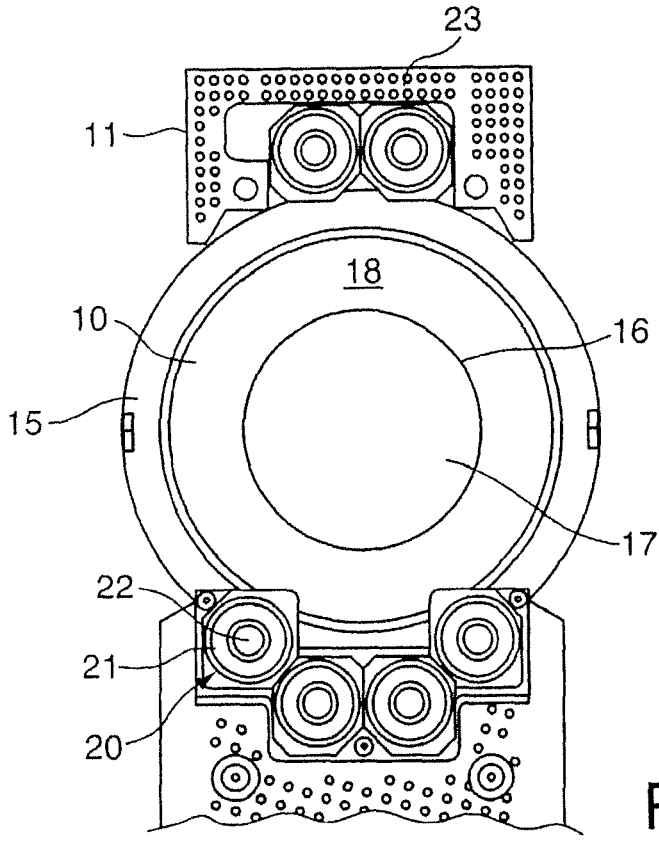
FIG. 2 shows a top view of a die and the region surrounding it.

FIG. 2 shows an elevation of a lower punching tool and the region surrounding it. Die 10 is held in a tool holder designed as a die holder 15. In the exemplary embodiment die 10 has a circular cutting edge 16 which delimits a die opening 17. Die edge 16 is aligned with a die holder surface 18. A blanking punch can pass cutting edge 16 during the punching process so that it projects into die opening 17. The punched part drops through die opening 17. In the exemplary embodiment six work supports 20 are arranged in the region around die 10, particularly in the region of die holder 15. Work supports 20 comprise a support element mounting 21 in which a support element 22 designed as a ball is mounted. Work supports 20 are spring mounted or supported, the spring force of the spring element 25 (FIG. 3) being adjustable. In the region outside die 10 and outside the region in which work supports 20 are arranged, work table 11 is provided with brushes 23 which support a workpiece, the supporting height and flexibility of brushes 23 not being variable. In some implementations, brushes 23 are replaced by an array of ball bearings (not shown) which are configured to provide the desired supporting height.

Figure 3:
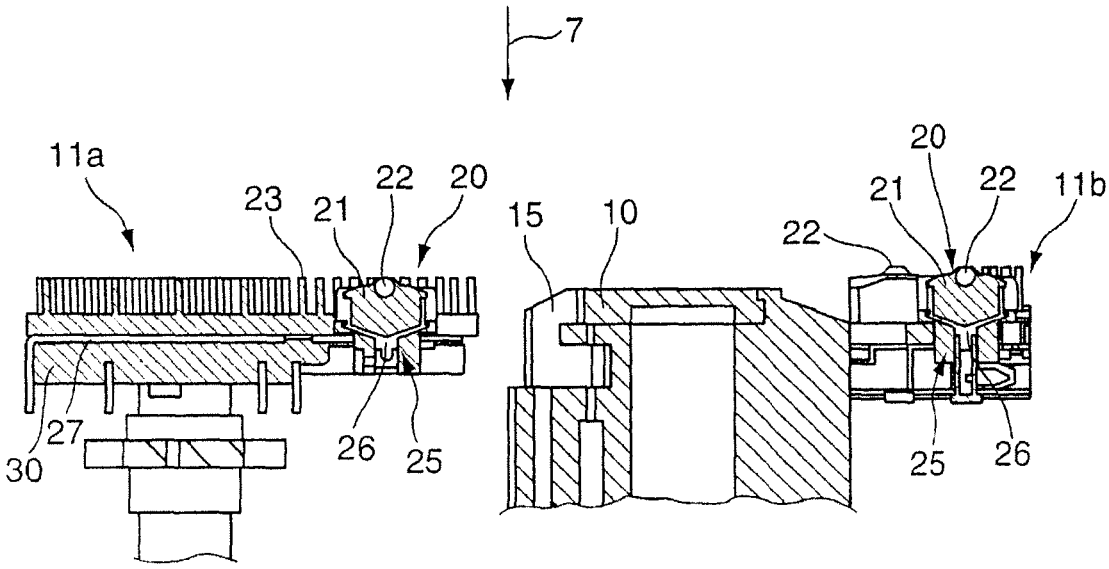
FIG. 3 shows a cross-section through the lower part of a punching machine.

According to the sectional representation in FIG. 3, work supports 20 are arranged on work table segments 11*a*, 11*b*. Each of the work supports 20 comprises a support element mounting 21 and a support element 22. Work supports 20 are supported by a spring element 25, spring element 25 comprising a pressure chamber 26 with an air cushion. Pressure chambers 26 are supplied with compressed air via compressed air lines 27. Work supports 20 are arranged in the immediate vicinity of die 10, which is retained by die holder 15. Support elements 22 are aligned with the free ends of brushes 23 when no punching is carried out. During the punching process support elements 22 can be moved, together with support element mountings 21, in machining stroke direction 7 against an adjustable restoring force generated by spring elements 25.

The restoring force generated by the spring elements 25 can be adjusted manually, e.g., by the operator manually actuating a pressure regulating valve 29 (FIG. 1). Alternatively, the restoring force may be adjusted automatically, for example by a controller 31 (shown diagrammatically in FIG. 1), e.g., a microprocessor, that is configured to adjust the pressure provided via compressed air lines 27. Adjustment may be performed in response to information obtained by or input into a weight recording device 32, shown diagrammatically in FIG. 1. In some cases, the weight recording device 32 is configured to sense the weight of the workpiece 9 prior to and during machining. In other cases, the weight recording device 32 is configured to calculate or otherwise obtain the weight of the workpiece 9 based on information input by the operator, e.g., the thickness of the workpiece. In some implementations, the weight recording device may be integral with the controller 31, e.g., the controller 31 may be programmed to provide this function, providing an integrated control system for adjusting the spring force.

Spring elements 25 are supported on the substructure 30 of work table 11. Work table segment 11*a* is designed so that it is vertically adjustable in order to allow the workpiece to avoid the claws of coordinate guide 13 when the workpiece is fed essentially horizontally to the die region.

A number of embodiments of the invention have been described. Nevertheless, it will be understood that various modifications may be made without departing from the spirit and scope of the invention. Accordingly, other embodiments are within the scope of the following claims.

What is claimed is:

1. A punching machine comprising:

a tool holder for a punching tool;

a die having a cutting edge which can be passed by the punching tool in a machining stroke direction and a return stroke direction, said cutting edge being operable to cut through a workpiece, at least one work support supported by at least one spring element, the at least one work support being arranged in the vicinity of the die and comprising a support element mounting supported by the spring element, and a support element mounted on the support element mounting, and a device configured to adjust a spring force of the spring element supporting the work support as a function of the weight or other characteristic related to the weight of the workpiece.

2. The punching machine according to claim 1, wherein the spring element and the work support are arranged on a work table in the vicinity of a die holder.

3. The punching machine according to claim 1 wherein the spring element comprises a pneumatic spring element.

4. The punching machine according to claim 3, further comprising a pressure chamber, in fluid communication with the spring element, in which an air cushion supporting the work support is formed.

5. The punching machine according to claim 1, wherein the support element mounting comprises a ball bearing and the support element comprises a ball.

6. The punching machine of claim 1 wherein the work support includes at least one brush.

7. The punching machine of claim 1, wherein the device is manually adjusted to change the spring force of the spring element.

8. The punching machine of claim 1, wherein the device automatically adjusts the spring force of the spring element.

9. The punching machine according to claim 8, wherein the spring force is adjustable during the machining of a workpiece.

10. The punching machine of claim 1 wherein the spring force is adjustable so that the workpiece is raised after machining and before displacement.

11. The punching machine of claim 1 further comprising a weight recording device configured to record the weight of a workpiece to be machined.

12. The punching machine according to claim 11, where the weight recording device is operably connected to the device configured to adjust the spring force.

13. The punching machine of claim 1, wherein the machine comprises a plurality of work supports, each work support interacting with a corresponding adjustable spring element, the work supports being arranged in the circumferential direction of a die holder.

14. The punching machine of claim 1, further comprising a work table on which the die is arranged, the portion of the work table outside the die and the region in which the work support(s) are arranged comprising a brush table or ball bearing table.

15. A method for supporting a workpiece in the region of a tool holder of a punching machine, the method comprising:

supporting at least one work support by at least one spring element, wherein the work support comprises a support element mounting supported by the spring element, and a support element mounted on the support element mounting, adjusting a spring force of the spring element supporting the work support as a function of the weight or other characteristic related to the weight of the workpiece, and actuating the punching machine to cut a portion of the workpiece.

16. The method according to claim 15, wherein the spring force is automatically adjusted.

17. The method according to claim 15, wherein the spring force is adjusted during the machining of a workpiece.

18. The method according to claim 17, wherein the spring force is adjusted as a function of the weight of the workpiece.

19. The method according to claim 18 wherein the weight of the workpiece is predetermined or recorded.

20. The method according to claim 18, wherein the weight of the workpiece is recorded during the workpiece machining.

* * * * *